US008016090B2

(12) United States Patent
McCoy et al.

(10) Patent No.: US 8,016,090 B2
(45) Date of Patent: Sep. 13, 2011

(54) COLLAPSIBLE CONTAINER

(75) Inventors: Ryan McCoy, Falcon Heights, MN (US); Angela L. Baer, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 574 days.

(21) Appl. No.: 12/180,267

(22) Filed: Jul. 25, 2008

(65) Prior Publication Data

US 2010/0018241 A1 Jan. 28, 2010

(51) Int. Cl.
*A45C 7/00* (2006.01)

(52) U.S. Cl. ..... 190/107; 383/2; 383/4; 383/120

(58) Field of Classification Search ..... 383/2, 4, 383/120; 190/107; 229/117.01, 117.02, 229/117.06; 220/666
See application file for complete search history.

(56) References Cited

U.S. PATENT DOCUMENTS

| | | | | | |
|---|---|---|---|---|---|
| 1,513,909 | A | * | 11/1924 | Hunter | 190/103 |
| 1,537,956 | A | * | 5/1925 | McNally | 383/2 |
| 1,553,697 | A | | 9/1925 | Lederer | |
| 1,604,658 | A | | 10/1926 | Post | |
| 1,666,704 | A | | 4/1928 | Hunter | |
| 2,425,035 | A | * | 8/1947 | Garnett et al. | 190/107 |
| 3,164,187 | A | | 1/1965 | Simmons | 150/35 |
| 4,090,542 | A | | 5/1978 | Hacker, Jr. | 150/1.7 |
| D265,290 | S | * | 7/1982 | Dolinsky | D3/328 |
| 4,671,393 | A | | 6/1987 | Rainey | 190/1 |
| 4,679,242 | A | | 7/1987 | Brockhaus | 383/4 |
| 5,044,699 | A | | 9/1991 | Duty | 383/37 |
| 5,265,960 | A | | 11/1993 | Shikler | 383/15 |
| 5,472,279 | A | | 12/1995 | Lin | 383/2 |
| 5,490,396 | A | | 2/1996 | Morris | 62/457.2 |
| 5,797,529 | A | * | 8/1998 | Lavine | 224/575 |
| 5,988,878 | A | * | 11/1999 | Simonett et al. | 383/2 |
| 6,068,402 | A | | 5/2000 | Freese et al. | 383/110 |
| 6,640,856 | B1 | | 11/2003 | Tucker | 150/130 |
| 7,163,340 | B2 | | 1/2007 | Godshaw et al. | 383/121 |
| 2001/0031104 | A1 | * | 10/2001 | Vazquez | 383/2 |
| 2004/0035143 | A1 | | 2/2004 | Mogil | 62/457.2 |
| 2004/0136621 | A1 | | 7/2004 | Mogil | 383/110 |
| 2007/0274613 | A1 | | 11/2007 | Pruchnicki et al. | 383/110 |
| 2009/0032348 | A1 | * | 2/2009 | Wang | 190/103 |

* cited by examiner

*Primary Examiner* — Tri Mai
(74) *Attorney, Agent, or Firm* — Theodore M. Magee; Westman, Champlin & Kelly, P.A.

(57) ABSTRACT

An insulated container has a front, back, top and bottom. Pairs of mating members are located on the front and pairs of mating members are located on the back to maintain the container in a collapsed state. The mating members on the front are positioned such that the mating members form a connection when the top of the container is folded on top of the front of the container. The mating members on the back are position such that the mating members form a connection when the bottom of the container is fold on top of the back of the container. In some embodiments, the mating members are positioned on portions of handles attached to the container.

18 Claims, 5 Drawing Sheets

COLLAPSIBLE CONTAINER

BACKGROUND

Insulated soft-sided containers are used to carry items that are to be kept cooler or warmer than the surrounding environment. Such containers typically have four insulated side walls, an insulated bottom and an insulated top that may be opened to gain access to the interior of the container. The top is usually secured to the side walls using a fastening mechanism such as a zipper or hook-and-loop materials, such as Velcro®. Many containers also include one or more handles for carrying the container.

When such a container is not in use, it is desirable to collapse the container so that it occupies less space during storage. The insulating material can make it difficult to keep the container in a collapsed state since the insulating material is resilient and resists being folded.

The discussion above is merely provided for general background information and is not intended to be used as an aid in determining the scope of the claimed subject matter.

SUMMARY

An insulated container has a front, back, top and bottom. Pairs of mating members are located on the front and pairs of mating members are located on the back to maintain the container in a collapsed state. The mating members on the front are positioned such that the mating members form a connection when the top of the container is folded on top of the front of the container. The mating members on the back are position such that the mating members form a connection when the bottom of the container is fold on top of the back of the container. In some embodiments, the mating members are positioned on portions of handles attached to the container.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

An insulated container is provided that has mating members on the front of the container and mating members on the back of the container to maintain the container in a collapsed state. The mating members on the front of the container are located near the top of the container such that when the mating members engage with each other, the top of the container is positioned over the front of the container with the exterior of the top facing outward. The mating members on the back of the container are located near the bottom of the container such that when the mating members engage with each other, the bottom of the container is positioned over the back of the container with the exterior of the bottom facing outward. In some embodiments, the container includes a handle that is attached to the container and the mating members are attached to portions of the handle that are attached to the container.

Figure 1:
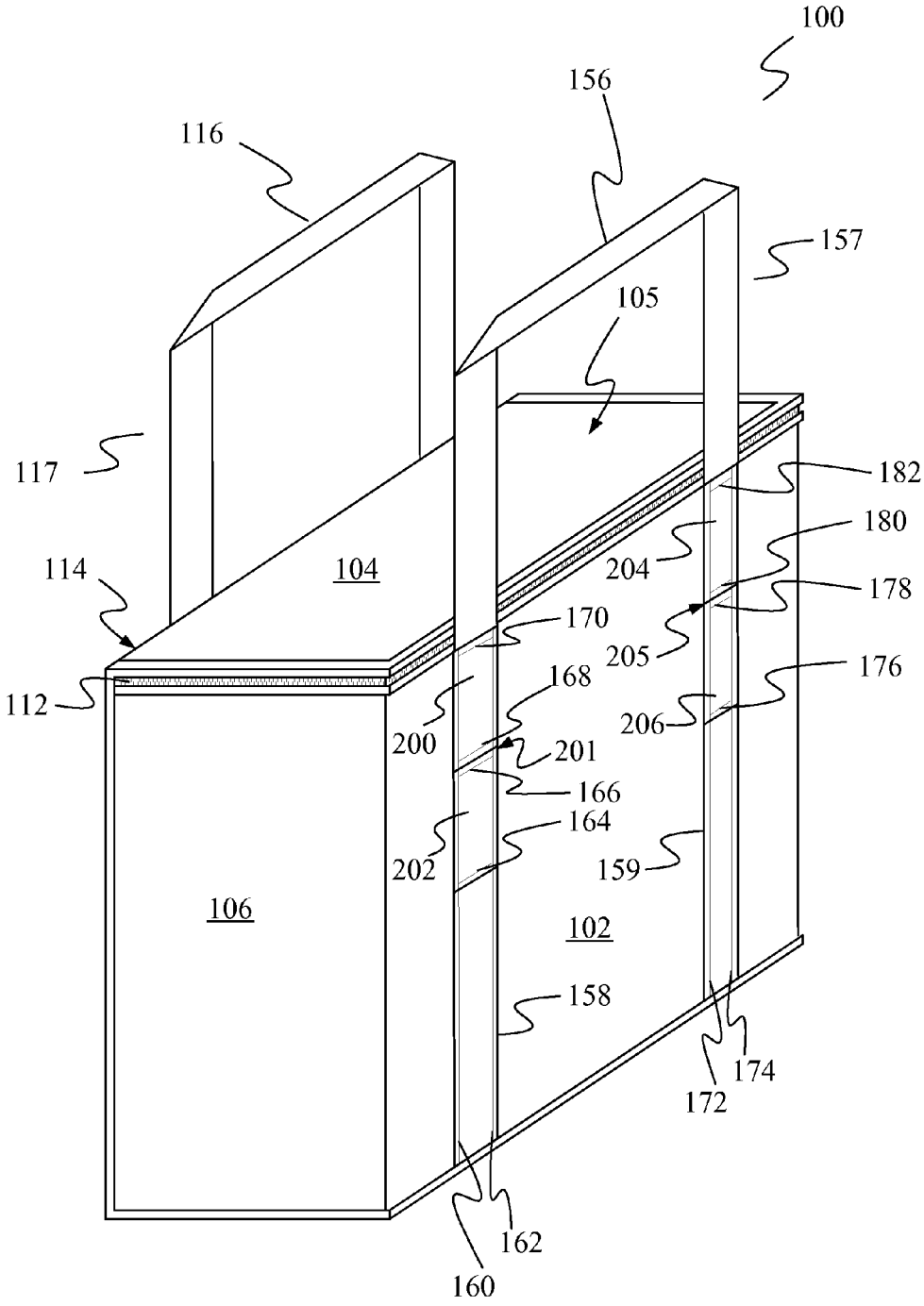
FIG. 1 is a perspective view of one embodiment of a container showing a front, top and side of the container.
Figure 2:
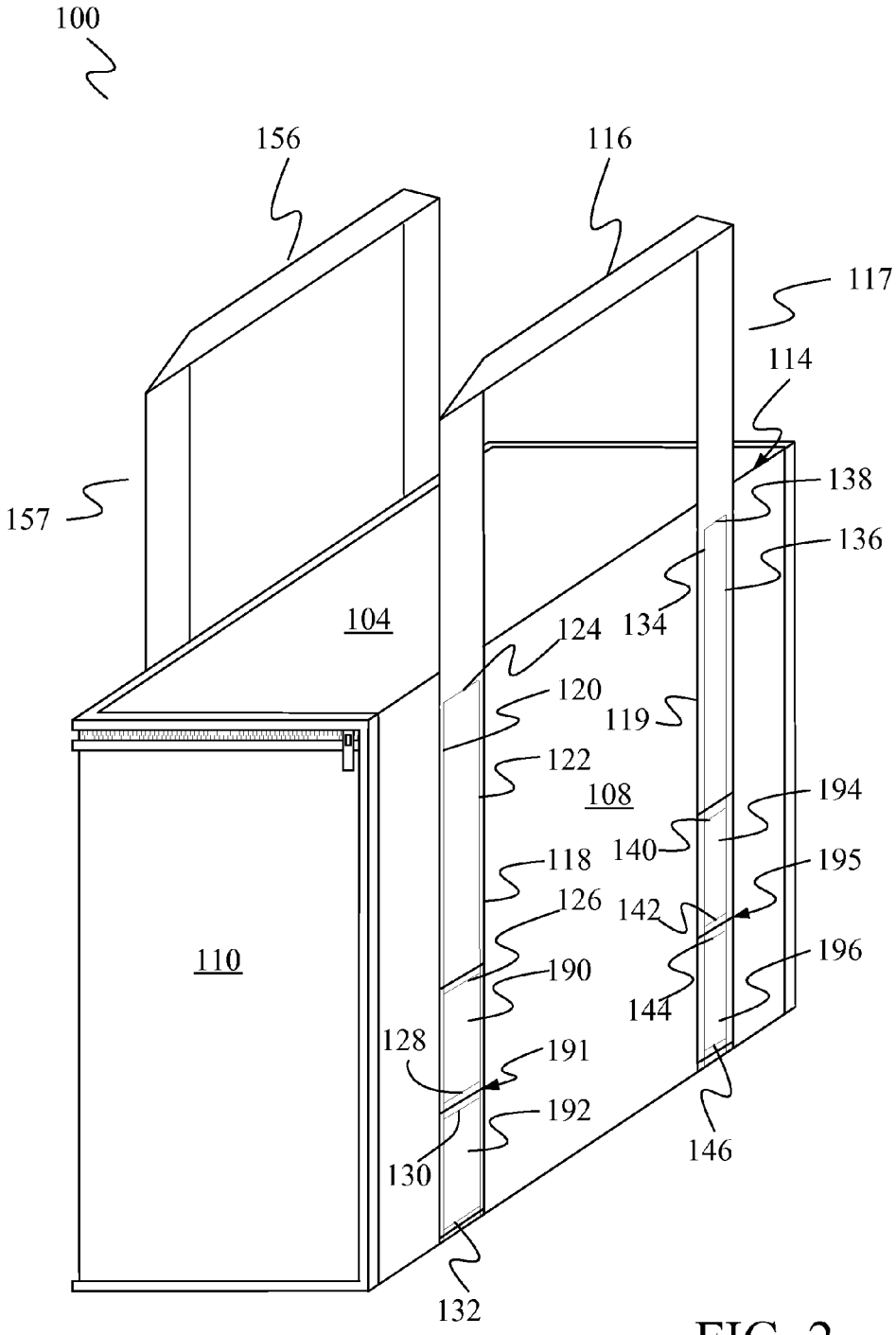
FIG. 2 is a perspective view of the container of FIG. 1 showing a back, top and side of the container.

FIG. 1 provides a perspective view of a bag or container 100 under one embodiment of the present invention showing a front or front panel 102, a top or top panel 104 and a side or side panel 106. FIG. 2 provides a perspective view of container 100 showing top 104, a back or back panel 108, and a second side or side panel 110. Note that front 102 and back 108 may be generically referred to as sides. The exterior of container 100 may be formed of a woven fabric or a plastic material such as polypropylene, for example. Each of front 102, top 104, back 108 and sides 106 and 110 includes a soft foam material that has sufficient rigidity to maintain the container in an upright position but may also be folded without permanently creasing the material. As such, container 100 is a soft-sided container.

Top 104 extends from back 108 at and edge 114 and is attached to sides 106 and 110 and front 102 by a zipper 112. Opening zipper 112 allows top 104 to pivot at edge 114 to thereby provide access to the interior of container 100. Top 104 includes an exterior surface 105 that faces outward.

A holding portion 116 of a handle or holding member 117 extends from the top of back 108. Two attachment portions 118 and 119 of handle 117 are attached to back 108. Under one embodiment, attachment portion 118 is attached to back 108 by stitching 120, 122, 124, 126, 128, 130, and 132 and attachment portion 119 is attached to back 108 by stitching 134, 136, 138, 140, 142, 144, and 146. A holding portion 156 of a handle or holding member 157 extends from the top of front 102. Two attachment portions 158 and 159 are attached to front 102. Under one embodiment, attachment portion 158 is attached to front 102 by stitching 160, 162, 164, 166, 168, and 170 and attachment portion 159 is attached to front 102 by stitching 172, 174, 176, 178, 180, and 182. In other embodiments, handle portions 118, 119, 158, and 159 may be attached to back 108 and front 102 using an adhesive or sonic welding.

Figure 3:
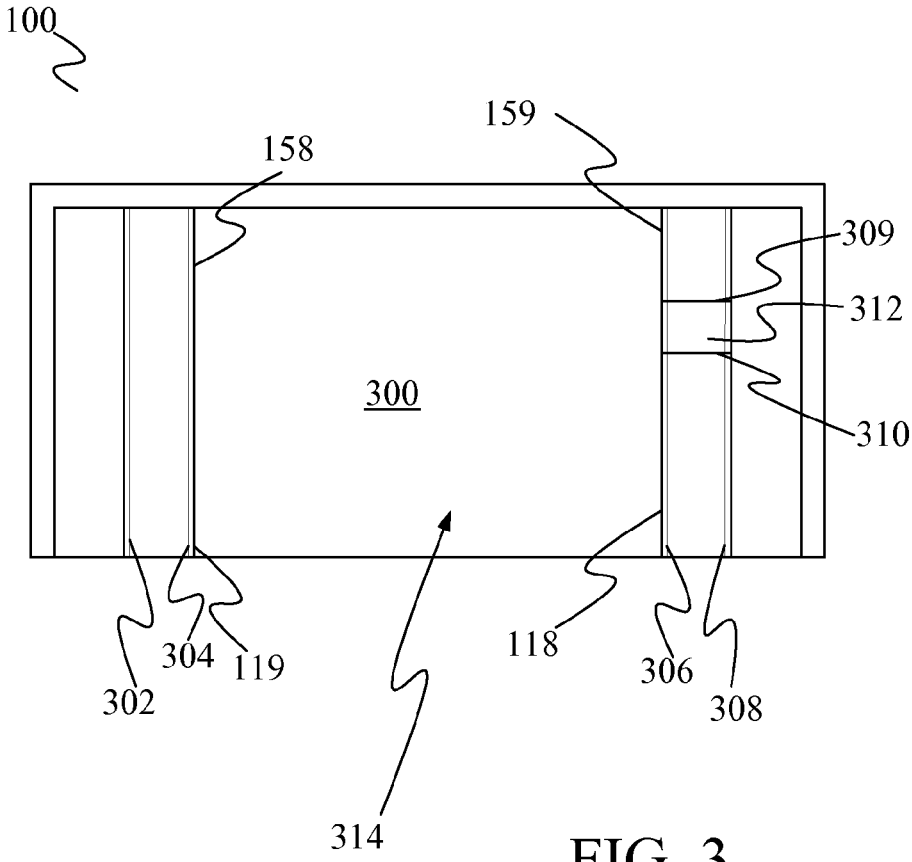
FIG. 3 is a bottom view of the container of FIG. 1.

FIG. 3 provides a bottom view of container 100 of FIGS. 1 and 2 showing a bottom or bottom panel 300 having and exterior surface 314. As shown in FIG. 3, attachment portions 118, 119, 158 and 159 extend along and are attached to a bottom 300 of container 100. In some embodiments, attachment portions 119 and 158 are attached to bottom 300 by stitching 302 and 304 and attachment portions 118 and 159 are attached to bottom 300 by stitching 306 and 308. Under some embodiments, attachment portions 119 and 158 are formed of a same piece of material that is continuous along bottom 300. In other embodiments, attachment portions 118 and 159 are formed of a same piece of material that is continuous along bottom 300. Extending holding portions 118, 119, 158 and 159 along bottom 300 provides added strength for the attachment of handles 117 and 157 to the container.

In one embodiment, handles 117 and 157 including holding portions 116 and 156 and attachment portions 118, 119, 158, and 159, including those portions extending along and attached to bottom 300, are made of a single strap. Under one such embodiment, ends 309 and 310 of the strap are attached together to form an overlap 312 along bottom 300 to thereby form a loop of material that includes handle 117 and handle 157.

Mating members, also referred to as a latching mechanism or closure members, are attached to attachment portions 118, 119, 158 and 159 of handles 117 and 157 and are used to maintain container 100 in a collapsed stated as discussed further below. In particular, mating members 190 and 192 are attached to attachment portion 118, mating members 194 and 196 are attached to attachment portion 119, mating members 200 and 202 are attached to attachment portion 158 and mating members 204 and 206 are attached to attachment portion 159. Mating members 190 and 192 are designed to engage with each other to form a connection and thus represent one latching mechanism. Similarly, mating members 194 and 196; 200 and 202; and 204 and 206 are each designed to engage with each other to form a connection and thus each pair of mating members represents a separate latching mechanism.

In one embodiment, the mating members are attached to the attachment portions and the container by stitching. For example, mating member 190 is attached to attachment portion 118 and back 108 by stitching 120, 122, 126 and 128. Mating member 192 is attached to attachment portion 118 and back 108 by stitching 120, 122, 130 and 132. Mating member 194 is attached to attachment portion 119 and back 108 by stitching 134, 136, 140 and 142. Mating member 196 is attached to attachment portion 119 and back 108 by stitching 134, 136, 144 and 146. Mating member 200 is attached to attachment portion 158 and front 102 by stitching 160, 162, 168 and 170. Mating member 202 is attached to attachment portion 158 and front 102 by stitching 160, 162, 164 and 166. Mating member 204 is attached to attachment portion 159 and front 102 by stitching 172, 174, 180 and 182. Mating member 206 is attached to attachment portion 159 and front 102 by stitching 172, 174, 176 and 178. In other embodiments, the mating members are attached to the handles using other means such as adhesive or sonic welding.

By attaching the mating members to the portions of the handles attached to the front and back of the container, the embodiments described above provide more support for the mating members. In addition, in some embodiments, the same stitching is used to attach both the mating members and the handles to the container, thereby reducing the cost of assembly. In other embodiments, the mating members are not positioned on the handles but instead are attached directly to the container.

In the embodiments of FIGS. 1 and 2, mating members 190 and 192 abut each other at a juncture 191, mating members 194 and 196 abut each other at a juncture 195, mating members 200 and 202 abut each other at a juncture 201 and mating members 204 and 206 abut each other at a juncture 205. Each mating member in an abutting pair of mating members is able to engage with the other mating member in the pair when the panel the pair of mating members is attached to is folded along the juncture between the abutting mating members. For example, mating member 190 is able to engage with mating member 192 when back 108 is folded at juncture 191 to form a connection that maintains mating member 190 near mating member 192.

In some embodiments, the abutting mating members are formed of hook-and-loop fabric strips, such as Velcro®, with one mating member providing the hooks and the other mating member providing the loops. In other embodiments, the mating members are made of magnetic materials oriented such that the two mating members are attracted to each other when their exteriors are folded together along the juncture between the two members. Other constructions for the mating members, including constructions where the two mating members do not abut, are within the scope of the invention, including snaps where one mating member provides a post and the other mating member provides a receptacle, buckles, buttons, and elastic loops.

In the embodiment of FIGS. 1 and 2, mating members 200 and 204 extend down from the top of front 102 while mating members 192 and 196 extend up from the bottom of back 108. Also, mating members 192 and 196 are both closer to bottom 300 than any of mating members 200, 202, 204, and 206. Thus, the mating members are positioned asymmetrically when comparing the position of the mating members on the front of the container to the position of the mating members on the back of the container.

Figure 4:
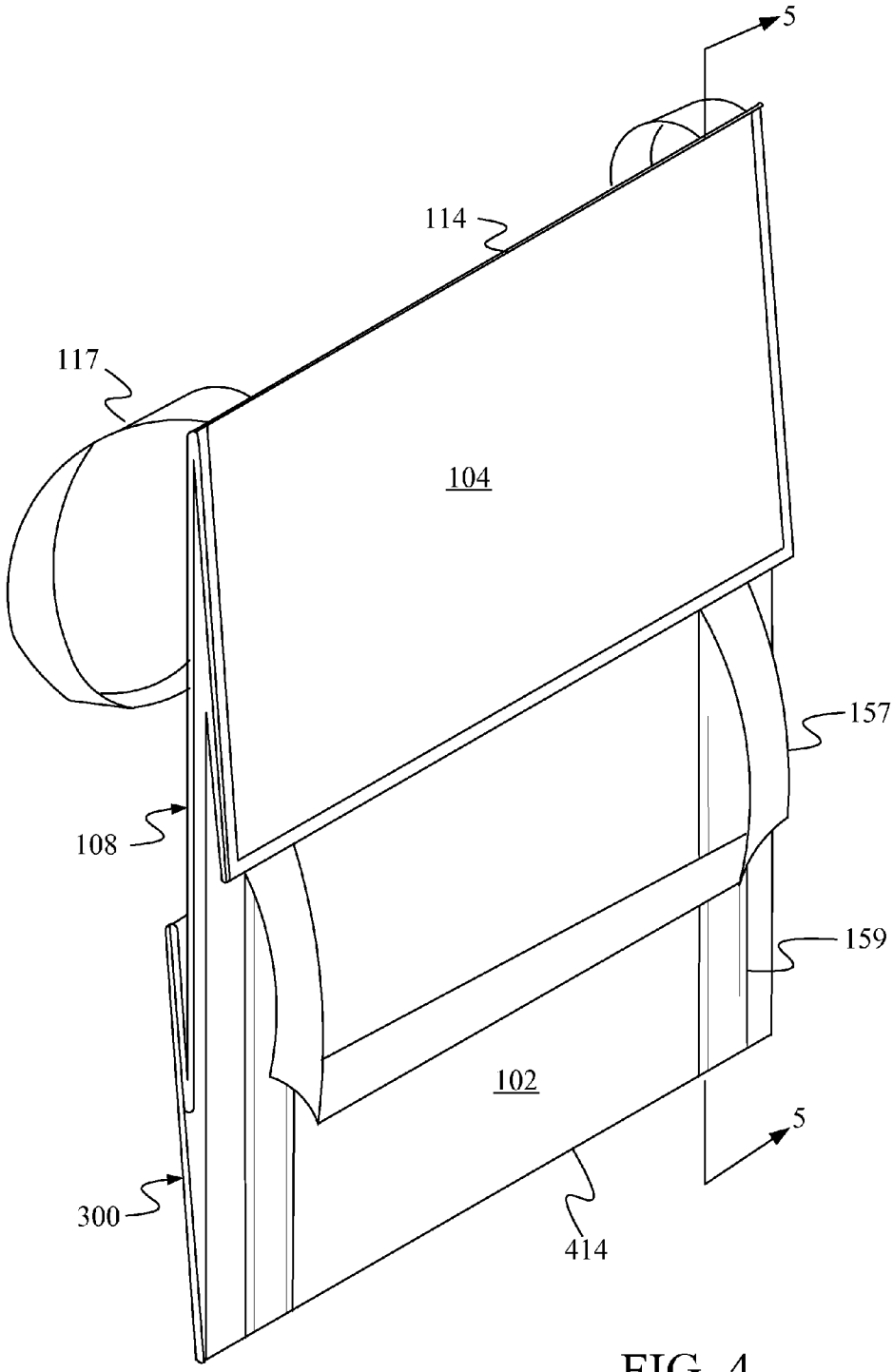
FIG. 4 is a perspective view showing the container of FIG. 1 in a collapsed state.

FIG. 4 shows container 100 of FIGS. 1-3 in a collapsed state. In FIG. 4, front 102 has been folded along junctures 201 and 205 (hidden in FIG. 4), causing top 104 to pivot at edge 114 so that top 104 is folded on top of front 102 with the exterior of top 104 facing outward. Similarly, back 108 has been folded along junctures 191 and 195 (also hidden in FIG. 4), causing bottom 300 to pivot along an edge 414 so that bottom 300 is folded over back 108 with the exterior of bottom 300 facing outward.

By folding top 104 toward front 102 and bottom 300 toward back 108, the embodiment of FIG. 4 provides a compact collapsed container. In particular, the thickness of the collapsed container in the direction from back 108 to front 102 is quite small since top 104 and bottom 300 do not overlap in the collapsed state. In addition, by folding bottom 300 away from front 102, the embodiment of FIG. 4 avoids interference with handle 157 that would otherwise occur, making it easier to collapse the container without having to manipulate handle 157.

Figure 5:
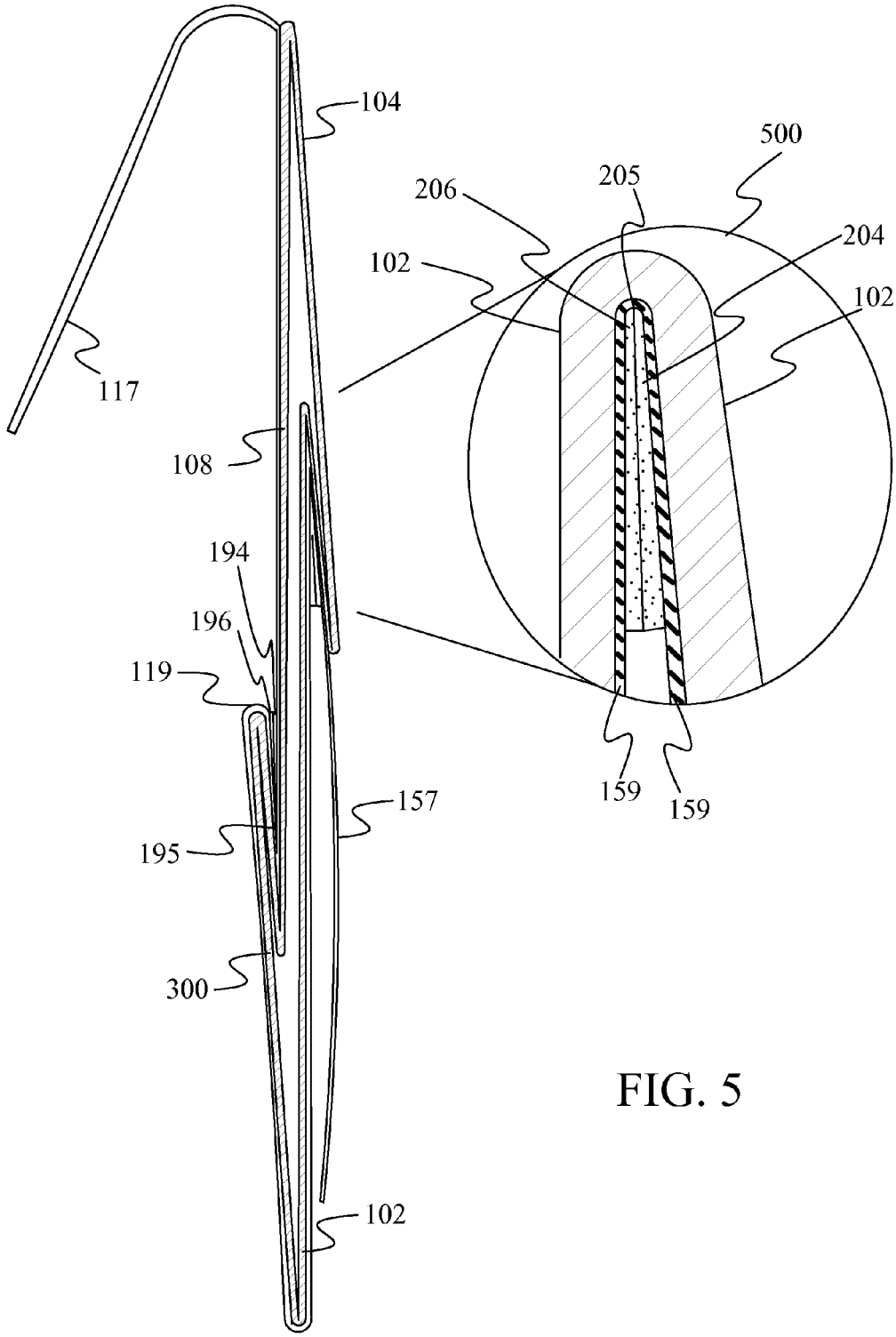
FIG. 5 is a cross-sectional view of the container of FIG. 4.

FIG. 5 provides a cross-sectional view of container 100 in its collapsed state taken along line 5-5 in FIG. 4 and includes a magnified area 500. Magnified area 500 shows in detail the engagement of mating member 206 with mating member 204 when container 100 is in the collapsed state after being folded along juncture 205. For example, in embodiments using hoop-and-loop material, the hoops of one of the mating members have engaged the loops of the other mating member in FIG. 5. Similarly, mating member 194 has engaged mating member 196 in FIG. 5.

The engagement of the mating members as shown in FIG. 5, maintains the mating members next to each other to thereby maintain container 100 in the collapsed state making it easier to store the container.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A container comprising:

a bottom having an exterior;

a top having an exterior;

a front extending from the bottom;

a back extending from the bottom opposite the front;

a strap attached to the front, the strap forming a handle;

first and second mating members positioned on the strap attached to the front such that folding a portion of the front to engage the first mating member with the second mating member positions the top over the front with the exterior of the top facing outwardly; and third and fourth mating members on the back such that folding a portion of the back to engage the third mating member with the fourth mating member positions the bottom over the back with the exterior of the bottom facing outwardly.

2. The container of claim 1 wherein the strap extends along and is attached to the bottom.

3. The container of claim 2 wherein the bottom comprises a bottom panel.

4. The container of claim 1 wherein the strap extends along and is attached to the back.

5. The container of claim 4 wherein the third and fourth mating members are attached to the strap.

6. The container of claim 5 wherein the strap forms a second handle.

7. The container of claim 1 wherein the first and second mating members and the third and fourth mating members comprise hook-and-loop fabric strips.

8. The container of claim 1 further comprising a zipper connection between the top and at least one of the front and back.

9. A bag comprising:

a top;

a bottom;

a first side;

a second side;

a first handle attached to the first side;

a first closure member attached to the first handle along a portion of the first handle attached to the first side;

a second closure member attached to the first handle along a portion of the first handle attached to the first side, the second closure member positioned relative to the first closure member such that when the first closure member engages the second closure member the top is positioned over the first side with an exterior surface of the top facing outward;

a second handle attached to the second side;

a third closure member attached to the second handle along a portion of the second handle attached to the second side; and a fourth closure member attached to the second handle along a portion of the second handle attached to the second side, the fourth closure member positioned relative to the third closure member such that when the third closure member engages the fourth closure member the bottom is positioned over the second side with an exterior surface of the bottom facing outward.

10. The bag of claim 9 wherein the first handle and the second handle are coupled together to form a loop such that two portions of the loop extend along thea bottom of the bag.

11. The bag of claim 9 further comprising:

a fifth closure member attached to the first handle along a portion of the first handle attached to the first side; and a sixth closure member attached to the first handle along a portion of the first handle attached to the first side.

12. The bag of claim 11 further comprising:

a seventh closure member attached to the second handle along a portion of the second handle attached to the second side; and an eighth closure member attached to the second handle along a portion of the second handle attached to the second side.

13. The bag of claim 9 wherein the portion of the first handle that the first closure member is attached to abuts the portion of the first handle that the second closure member is attached to.

14. The bag of claim 13 wherein the portion of the second handle that the third closure member is attached to abuts the portion of the second handle that the fourth closure member is attached to.

15. The bag of claim 14 wherein the portion of the first handle that the first closure member is attached to extends from the top of the bag and the portion of the second handle that the third closure member is attached to extends from the bottom of the bag.

16. A soft-sided container comprising:

a top panel having an exterior surface;

a bottom panel having an exterior surface;

a first side panel having a first latching mechanism such that folding a portion of the first side panel to engage the first latching mechanism positions the top panel over the first side panel with the exterior surface of the top panel outwardly facing;

a second side panel having a second latching mechanism such that folding a portion of the second side panel to engage the second latching mechanism positions the bottom panel over the second side panel with the exterior surface of the bottom panel outwardly facing; and a holding member attached to the first side panel, wherein the first latching mechanism is attached to the holding member.

17. The soft-sided container of claim 16 further comprising a second holding member attached to the second side panel wherein the second latching mechanism is attached to the second holding member.

18. The soft-sided container of claim 17 wherein at least one of the first holding member and the second holding member are attached to the bottom panel.

* * * * *